US006523697B1

(12) United States Patent
Malatesta et al.

(10) Patent No.: US 6,523,697 B1
(45) Date of Patent: Feb. 25, 2003

(54) MAIL PROCESSING MACHINE DROP BOX AND METHOD

(75) Inventors: James Malatesta, Hockessin, DE (US); Matthew Schroeder, Wilmington, DE (US)

(73) Assignee: Tritek Technologies, Inc., DE (US)

( * ) Notice: Subject to any disclaimer, the term of this patent is extended or adjusted under 35 U.S.C. 154(b) by 0 days.

(21) Appl. No.: 09/675,271

(22) Filed: Sep. 29, 2000

Related U.S. Application Data

(60) Provisional application No. 60/157,262, filed on Oct. 1, 1999.

(51) Int. Cl.[7] ..... B07C 9/00

(52) U.S. Cl. ..... 209/656; 209/900; 198/367; 271/297

(58) Field of Search ..... 198/360, 367, 198/369; 271/184, 185, 303, 305, 297; 209/656, 657, 900

(56) References Cited

U.S. PATENT DOCUMENTS 4,662,522 A * 5/1987 Kokubun et al. ..... 209/656
5,226,547 A 7/1993 Malatesta ..... 209/657
5,340,099 A * 8/1994 Romanenko et al. ... 198/367 X
5,398,922 A 3/1995 Malatesta ..... 271/11
5,513,782 A * 5/1996 Rosso ..... 209/656 X
5,521,365 A 5/1996 Malatesta ..... 235/454
5,544,758 A 8/1996 Malatesta et al. ..... 209/584
5,649,629 A * 7/1997 Kennedy, Jr. ..... 209/900 X

* cited by examiner

*Primary Examiner*—Tuan N. Nguyen
(74) *Attorney, Agent, or Firm*—Schnader Harrison Segal & Lewis LLP

(57) ABSTRACT

A mail processing system drop box assembly. The drop box assembly includes a diverter and a sliding board. The sliding board is positioned below the diverter. A top edge of the sliding board is substantially parallel to the bottom edge of the diverter and extends partially to the interior side of the diverter so that a space is left between the sliding board top edge and the diverter bottom edge. The space is of sufficient size to allow a mail item to pass through edgewise. A slide portion of the sliding board section is at an angle greater than 90° to a front portion of the diverter. Mail items are received into the drop box assembly edgewise at an angle to the diverter front portion such that mail items undergo a substantially abrupt directional change substantially stopping forward momentum and thereby falling into the slide in a substantially controlled manner. Further disclosed are a mail processing system and a mail processing method.

19 Claims, 6 Drawing Sheets

MAIL PROCESSING MACHINE DROP BOX AND METHOD

This application is related to and claims priority from U.S. Provisional Application Serial No. 60/157,262 filed Oct. 1, 1999, titled Mail Sorting Machine Drop Box and Double Separator Module, the disclosure of which is hereby incorporated by reference.

FIELD OF THE INVENTION

The invention relates to mail processing machines, and more particularly to a mail processing machine drop box.

BACKGROUND OF THE INVENTION

Mail processing machines, such as those used to sort mail, typically include a plurality of stacking bins into which mail items are sorted. Mail items generally exit the machine positioned with a face substantially parallel to the floor of the stacking bin which allows items to sail beyond the stacking bins. Additionally, the mail items are imparted with forward momentum from the mail processing machine that is proportional to the speed at which the machine is operating. This momentum may also cause mail items to overshoot the stacking bins and generally enter them in an uncontrolled manner. The higher the machine speed, the more uncontrolled the delivery of the mail items into the stacking bins. This limits the speed at which mail processing machines may operate. Accordingly, there is a need for a mail processing machine that can perform at high speeds and deliver mail items into stacking bins in a controlled manner.

SUMMARY OF THE INVENTION

A mail processing system drop box assembly is disclosed. In an illustrative embodiment of the invention the drop box assembly comprises a diverter and a sliding board. The sliding board is positioned below the diverter. A top edge of the sliding board is substantially parallel to the bottom edge of the diverter and extends partially to the interior side of the diverter so that a space is left between the sliding board top edge and the diverter bottom edge. The space is of sufficient size to allow a mail item to pass through edgewise. A slide portion of the sliding board section is at an angle greater than 90° to a front portion of the diverter. Mail items are received into the drop box assembly edgewise and at an angle to the diverter front portion such that mail items undergo a substantially abrupt directional change thereby substantially stopping their forward momentum and falling into the slide in a substantially controlled manner.

Further disclosed are a mail processing system and a mail processing method.

DETAILED DESCRIPTION OF THE INVENTION

Figure 1:
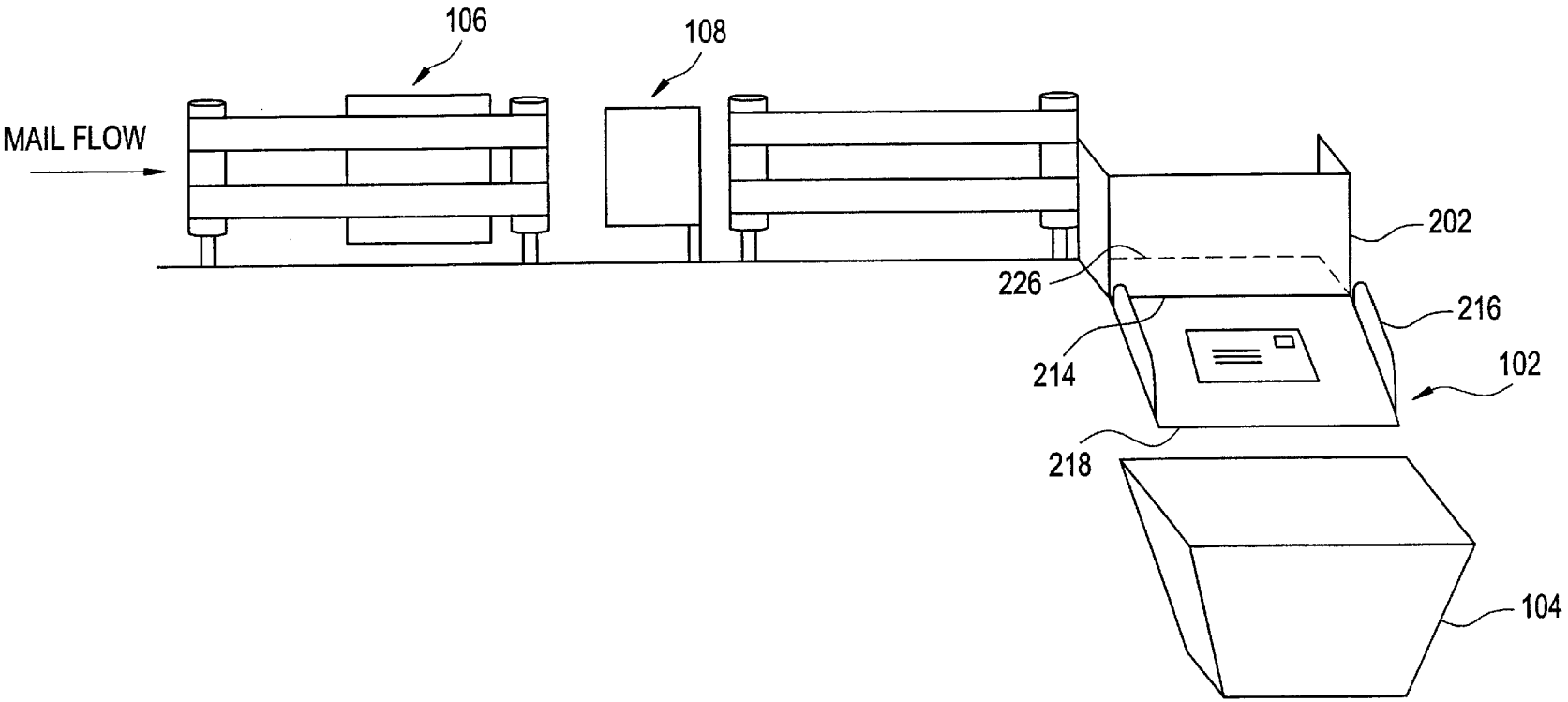
FIG. 1 depicts a mail processing machine with a drop box assembly according to an illustrative embodiment of the invention.

The invention includes a mail processing system drop box assembly such as used in a mail processing machine. FIG. 1 depicts a mail processing machine 100 with a drop box assembly 102 according to an illustrative embodiment of the invention. Machine 100 comprises a feeder assembly 106 into which mail items are fed, and a sorter and transport assembly 108 to catagorize mail items and to transport mail items into sorting receptacles 104. As will be understood by those skilled in the art other configurations that sort and transport mail items may be used are within the spirit and scope of the invention. Drop box assembly 102 comprises a diverter 202 and a sliding board 216. Sliding board 216 is positioned below and at an angle to diverter 202. A bottom edge 214 of diverter 202 overlaps a top edge 226 of sliding board 216. The overlap provides a space between sliding board 216 and diverter 202 of sufficient size to allow a mail item to pass through edgewise. A slide portion 218 of sliding board 216 is at an angle greater than 90° to diverter 202 to allow mail items to slide from sliding board 216 into a receptacle 104. Mail items are received into the drop box assembly 102 edgewise and at an angle 206 such that mail items undergo a substantially abrupt directional change thereby substantially stopping forward momentum and falling into the slide in a substantially controlled manner. "Controlled manner" means that the mail items come to rest in a receptacle as desired without overshooting it, and rest in an organized fashion.

Figure 2:
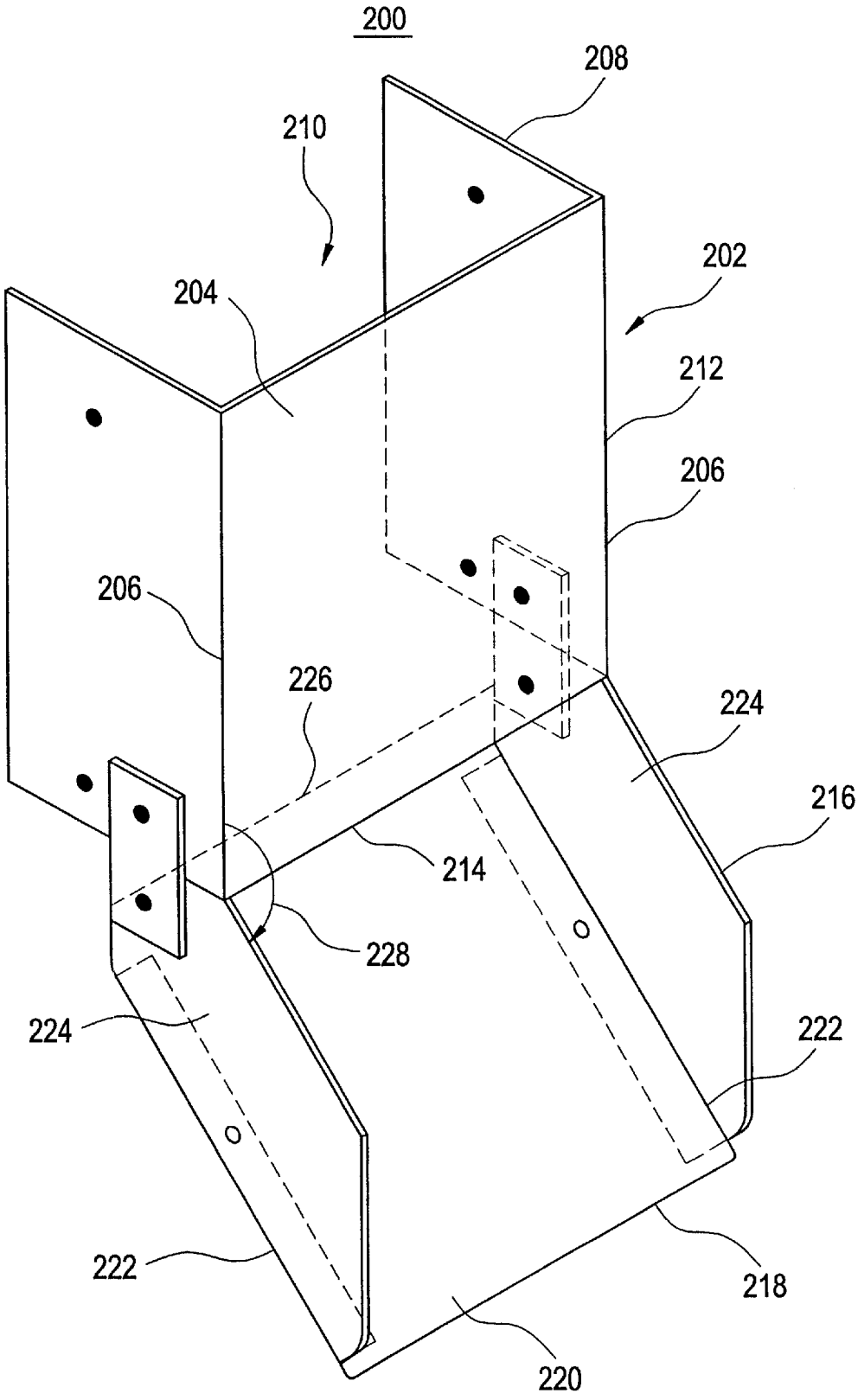
FIG. 2 depicts a perspective view of a drop box assembly having two diverter side portions at 90° to a diverter front portion according to an illustrative embodiment of the invention.

FIG. 2 depicts a perspective view of a drop box assembly according to an illustrative embodiment of the invention. A diverter 202 is provided having a front portion 204 with two front portion ends 206. Optionally, diverter 202 has at least one side portion 208. Front portion 204 has an interior face 210 and an exterior face 212 and a bottom edge 214. The one or more side portions 208 may extend from the front portion interior space 210 at ends 206. A sliding board 216 is provided having a slide portion 218 with a top surface 220. The slide portion has two longitudinal ends 222 and optionally one or more side portions 224 extending from top surface 220 at the longitudinal ends. The sliding board 216 is positioned below diverter 202 with a slide portion top edge 226 substantially parallel to diverter front portion bottom edge 214. Sliding board 216 extends partially to the interior side of diverter 202 leaving a space between slide portion top edge 226 and diverter front portion bottom edge 214 of sufficient size to allow a mail item to pass through edgewise. Slide portion 218 is at an angle 228 greater than 90° to diverter front portion 204.

Figure 6:
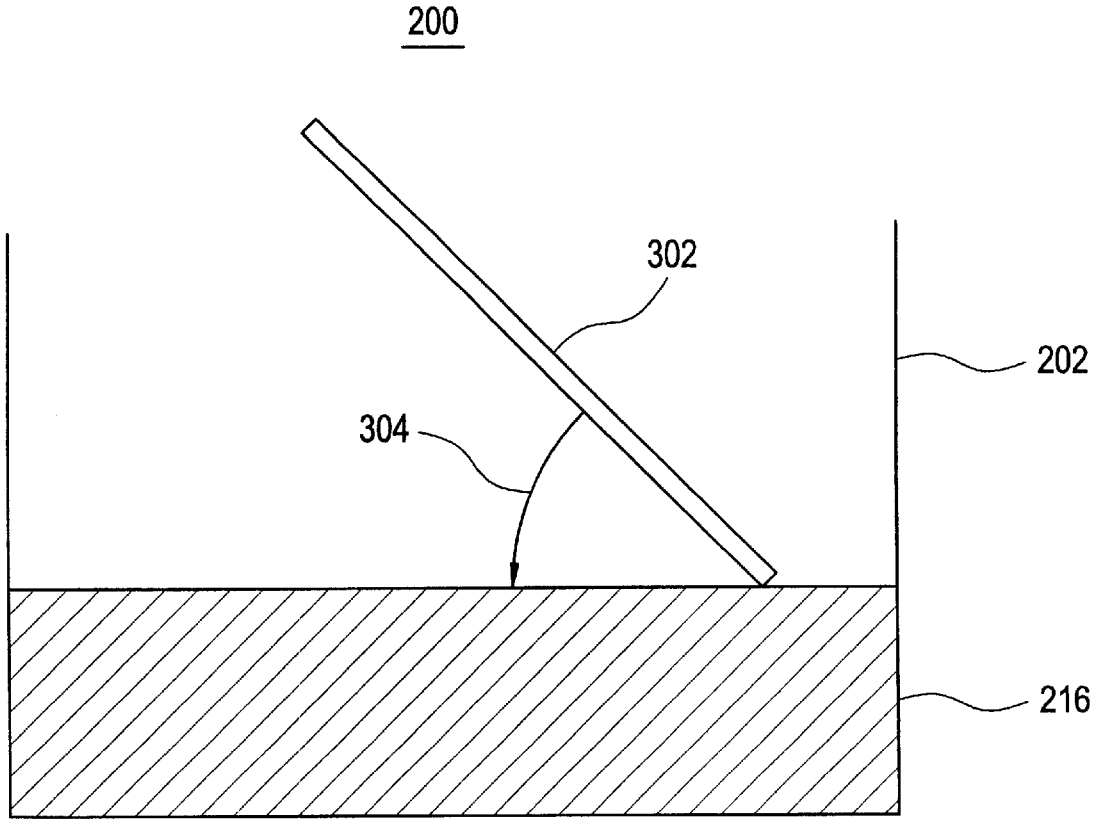
FIG. 6 depicts a top view of a drop box assembly according to an illustrative example of the invention.

FIG. 6 depicts a top view of drop box assembly 200. Mail items 302 are received into drop box assembly 200 at an angle 304 to diverter front portion 204 such that mail items 302 undergo a substantially abrupt directional change thereby substantially stopping their forward momentum and fall into sliding board 216 in a substantially controlled manner.

Figure 3:
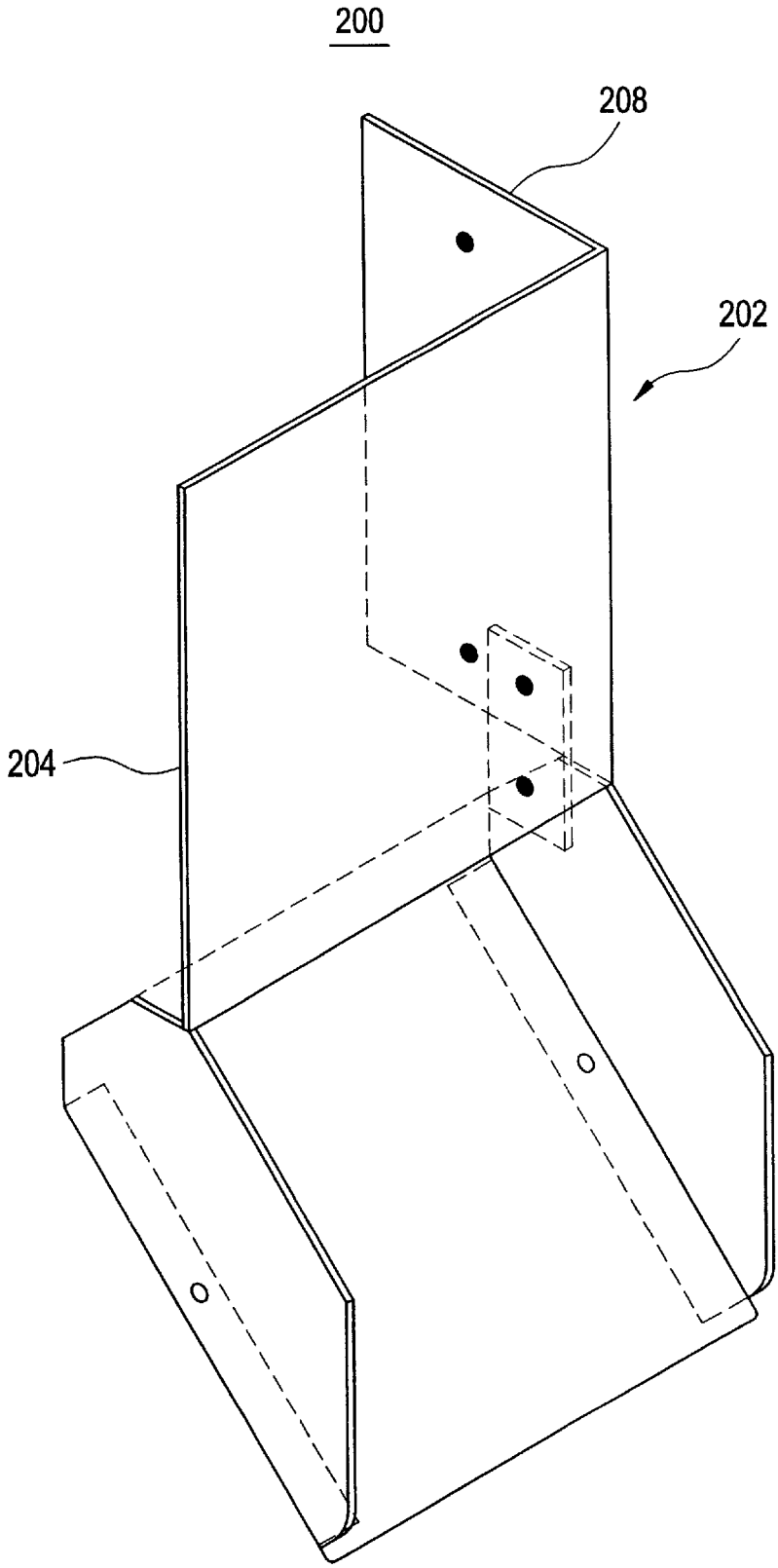
FIG. 3 depicts a perspective view of the drop box assembly having one diverter side portion according to an illustrative embodiment of the invention.
Figure 4:
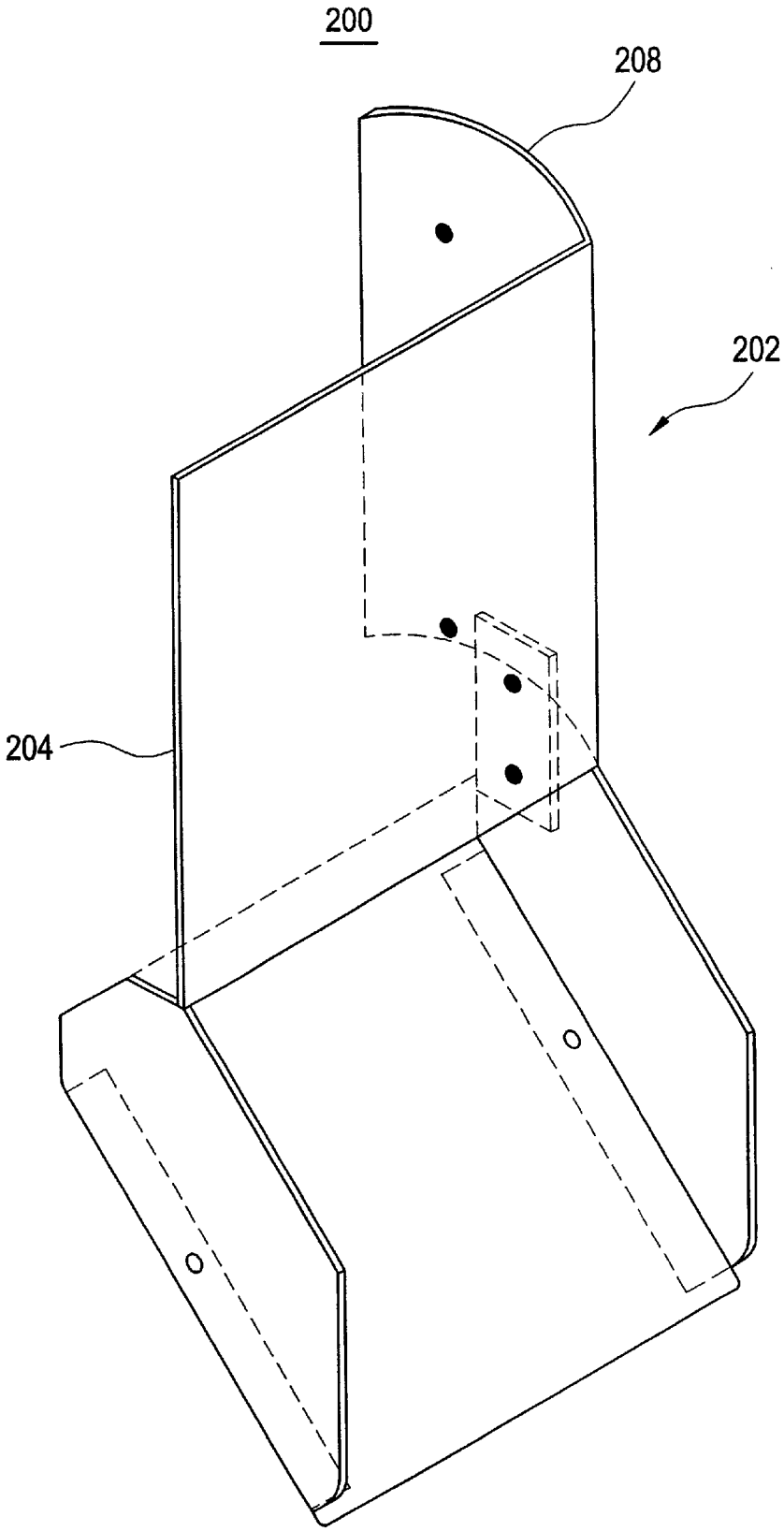
FIG. 4 depicts a perspective view of the drop box assembly having a curved diverter side portion according to an illustrative embodiment of the invention.
Figure 5:
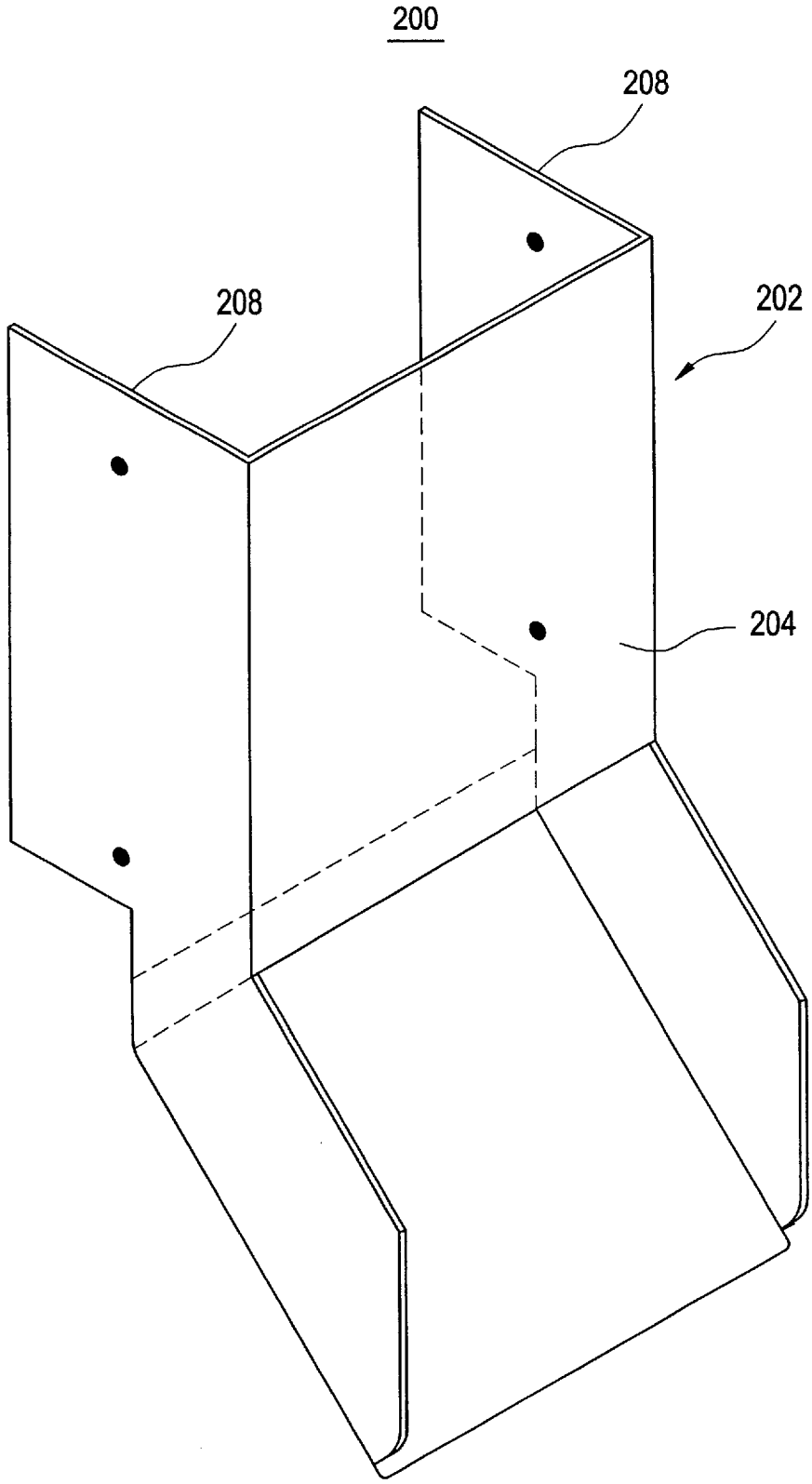
FIG. 5 depicts a drop box assembly formed of one piece of material according to an illustrative embodiment of the invention.

Numerous diverter shapes may be used. Additional illustrative examples are depicted in FIGS. 3 through 5. FIG. 3 depicts an exemplary diverter 202 having one side portion 208 extending at an angle of approximately 90° from front portion 204 toward the interior diverter side. FIG. 4 depicts a diverter 202 having a curved side portion 208 extending from and to the interior side of front portion 204. Any degree of rounding sufficient to contain mail items in the assembly, provide structural stability or fit within the machine configuration without adversely affecting functioning of the drop box assembly or other components of the machine are within the spirit and scope of the invention. FIG. 5 depicts a diverter 202 having two side portions 208 extending from and to the interior of front portion 204. In this embodiment the corners at side portion/front portion interfaces are slightly rounded.

Sliding board 216 may be fixedly attached to diverter 202, thereby maintaining the angle between the diverter front 204 and slide portion 218 of sliding board 216. Attachment may be by any means that would withstand the force of mail progressing through the assembly. Brackets may be used to fasten diverter 202 to sliding board 216. Examples of fastening methods for use with or without brackets include, but are not limited to, epoxy and bolts. Sliding board 216 may also be removably attached to diverter 202 to allow the angle between slide portion 218 and diverter front 204 to be adjusted. In an illustrative example, the angle may be adjusted in the range of greater than 90° to less than 180°. Such adjustments would allow for different types of mail items, different size mail receptacles or different positioning of mail receptacles with respect to the mail processing machine.

Mail box drop assembly 200, including diverter 202 and sliding board 216 may be formed of a single piece of material as shown in FIG. 5. Diverter 202 including front and side portions 204 and 208, respectively may also be formed from a single piece of material or from more than one piece. For example, diverter side portion(s) 208 may be separate piece(s) from diverter front portion 204. Similarly, sliding board 216 may be formed from one or more pieces. Any fastening means compatible with the materials and function of the pieces may be used. When forming either diverter 202 or sliding board 216 from a single piece, the side portions of either component can readily be made to curve as shown with respect to diverter 202 in FIGS. 4 and 5. Both sliding board side portions 224 and diverter side portions 208 may be at substantially 90° to the slide portion 218 and diverter front section 204, respectively. Other angles may be used that maintain the mail within the assembly, provide structural stability or fit within the machine configuration without adversely affecting functioning of the drop box assembly or other components of the mail processing machine.

Angle 304 between the mail item path and diverter front portion 204 is preferably in the range of about 25° to about 75° and more preferably in the range of about 40° to about 50°. This allows the mail item to be diverted into sliding board 216 and stack neatly within a receptacle.

Further disclosed is a mail processing system including a drop box assembly as described herein.

Still further disclosed is a method for processing mail using a drop box assembly as described herein.

While the invention has been described by illustrative embodiments, additional advantages and modifications will occur to those skilled in the art. Therefore, the invention in its broader aspects is not limited to specific details shown and described herein. Modifications, for example, to the materials and shape of the drop box assembly provided that mail enters receptacles in a substantially controlled manner, may be made without departing from the spirit and scope of the invention. Accordingly, it is intended that the invention not be limited to the specific illustrative embodiments but be interpreted within the full spirit and scope of the appended claims and their equivalents.

What is claimed is:

1. A mail processing system drop box assembly comprising:

a diverter having a front portion, the front portion having an interior face and a bottom edge;

a sliding board having a slide portion with a top surface and a top edge;

wherein the sliding board is positioned proximate to the diverter with the slide portion top edge substantially parallel to the diverter front portion bottom edge, and extending partially to the interior side of the diverter front portion leaving a space between the slide portion top edge and the diverter front portion bottom edge of sufficient size to allow a mail item to pass through edgewise, and wherein the slide portion is at an angle greater than 90° to the diverter front portion; and wherein mail items are received into the drop box assembly edgewise and at an angle to the diverter front portion such that mail items undergo a substantially abrupt directional change by hitting the diverter front portion, thereby substantially stopping forward momentum and falling into the slide in a substantially controlled manner.

2. The drop box assembly of claim 1 wherein the diverter front portion has two ends and at least one side portion extending from the front portion interior fact at the end(s).

3. The drop box assembly of claim 2 wherein the diverter side portion(s) extend at an angle of about 90° to the interior face of the diverter front portion.

4. The drop box assembly of claim 2 wherein the diverter side portion(s) curve from the front portion end(s) to the interior side of the front portion.

5. The drop box assembly of claim 2 wherein the diverter is formed of one piece of material.

6. The drop box assembly of claim 2 wherein the diverter comprises one side portion.

7. The drop box assembly of claim 2 wherein the diverter comprises two side portions.

8. The drop box assembly of claim 1 wherein the slide portion has 2 longitudinal ends and at least one side portion extending from the top surface at the longitudinal ends.

9. The drop box assembly of claim 8 wherein the sliding board side portion(s) are at an angle of about 90° to the slide portion and extend from the top slide surface at the longitudinal ends.

10. The drop box assembly of claim 8 wherein the side portions curve from the slide portion top surface at the longitudinal ends.

11. The drop box assembly of claim 8 wherein the sliding board is formed of one piece of material.

12. The drop box assembly of claim 1 wherein the sliding board is fixedly attached to the diverter.

13. The drop box assembly of claim 1 wherein the sliding board is moveably attached to the diverter to allow the angle between the slide portion and the diverter front portion to be adjusted to an amount in the range of greater than 90° to less than 180°.

14. The drop box assembly of claim 1 wherein the sliding board and the diverter are formed from one piece of material.

15. The drop box assembly of claim 1 wherein the angle between the mail item and the diverter front portion is in the range of about 25° to about 75°.

16. A mail processing system comprising a drop box assembly according to claim 1.

17. A mail processing method used in a mail processing system having a drop box according to claim 1, the method comprising propelling the sorted mail items edgewise toward and at an angle to a diverter front portion of a drop box assembly such that they undergo a substantially abrupt directional change thereby substantially stopping forward momentum and falling into a slide in a substantially controlled manner.

18. A mail processing system drop box assembly comprising:

a diverter having two side portions, including a front portion, the front portion having an interior face, a bottom edge and two ends, wherein at least one side portion extends from the front portion interior face at the end(s);

a sliding board having a slide portion with a top surface and a top edge;

wherein the sliding board is positioned proximate to the diverter with the slide portion top edge substantially parallel to the diverter front portion bottom edge, and extending partially to the interior side of the diverter front portion leaving a space between the slide portion top edge and the diverter front portion bottom edge of sufficient size to allow a mail item to pass through edgewise, and wherein the slide portion is at an angle greater than 90° to the diverter front portion; and wherein mail items are received into the drop box assembly edgewise and at an angle to the diverter front portion such that mail items undergo a substantially abrupt directional change thereby substantially stopping forward momentum and falling into the slide in a substantially controlled manner.

19. A mail processing system drop box assembly comprising:

a diverter having a front portion, the front portion having an interior face and a bottom edge;

a sliding board having a slide portion with a top surface and a top edge;

wherein the sliding board is positioned proximate to the diverter with the slide portion top edge substantially parallel to the diverter front portion bottom edge, and extending partially to the interior side of the diverter front portion leaving a space between the slide portion top edge and the diverter front portion bottom edge of sufficient size to allow a mail item to pass through edgewise, and wherein the slide portion is at an angle greater than 90° to the diverter front portion;

wherein mail items are received into the drop box assembly edgewise and at an angle to the diverter front portion such that mail items undergo a substantially abrupt directional change thereby substantially stopping forward momentum and falling into the slide in a substantially controlled manner; and wherein the sliding board is moveably attached to the diverter to allow the angle between the slide portion and the diverter front portion to be adjusted to an amount in the range of greater than 90° to less than 180° and to increase or decrease the space for the mail item to pass through.

* * * * *